US011339593B2

(12) United States Patent
Radford

(10) Patent No.: US 11,339,593 B2
(45) Date of Patent: May 24, 2022

(54) BUTT HINGE

(71) Applicant: Sixpence Industries Limited, Gloucester (GB)

(72) Inventor: Harry Radford, Gloucester (GB)

( * ) Notice: Subject to any disclaimer, the term of this patent is extended or adjusted under 35 U.S.C. 154(b) by 0 days.

(21) Appl. No.: 17/157,274

(22) Filed: Jan. 25, 2021

(65) Prior Publication Data

US 2021/0230917 A1 Jul. 29, 2021

(30) Foreign Application Priority Data

Jan. 23, 2020 (GB) ..... 2000966

(51) Int. Cl.
*E05D 7/04* (2006.01)
*E05D 5/04* (2006.01)

(52) U.S. Cl.
CPC ..... *E05D 5/04* (2013.01); *E05D 7/04* (2013.01); *E05Y 2900/132* (2013.01)

(58) Field of Classification Search
CPC ..... Y10T 16/532; Y10T 16/53225; Y10T 16/53235; Y10T 16/53253; Y10T 16/53257; E05D 5/04; E05D 7/04; E05D 7/0415; E05D 7/0423; E05D 7/0054; E05Y 2900/132; E05Y 2900/20
See application file for complete search history.

(56) References Cited

U.S. PATENT DOCUMENTS

| | | | | |
|---|---|---|---|---|
| 604,713 | A * | 5/1898 | Benson | E05D 7/04 16/235 |
| 1,234,696 | A | 7/1917 | Fleischer | |
| 3,006,443 | A | 10/1961 | Siler | |
| 5,141,357 | A * | 8/1992 | Sherman | F16B 5/025 403/4 |
| 6,202,255 | B1 * | 3/2001 | Sitter | E05D 7/0415 16/239 |
| 2002/0075509 | A1 * | 6/2002 | Wiechers | G06F 3/1204 358/1.15 |
| 2007/0056143 | A1 | 3/2007 | Ganter | |
| 2007/0169311 | A1 * | 7/2007 | Franchini | E05D 7/04 16/236 |

FOREIGN PATENT DOCUMENTS

| | | | | |
|---|---|---|---|---|
| DE | 19943567 | A1 * | 4/2001 | E05D 5/0246 |
| EP | 1127527 | A2 * | 8/2001 | E05D 7/0415 |
| EP | 1201171 | | 8/2008 | |

* cited by examiner

*Primary Examiner* — Chuck Y Mah
(74) *Attorney, Agent, or Firm* — Ryan Alley IP

(57) ABSTRACT

Several problems may be encountered when hanging a door with a butt hinge. Small margins of error in the alignment of the butt hinge may lead to the door being incorrectly hung. The present invention provides a butt hinge 100 comprising receiving apertures 140 configured to selectively receive first inserts 160 or second inserts 170. The first inserts 160 comprise concentric apertures 165 and the second inserts 170 comprise eccentric apertures 175. Selection and arrangement of the inserts 160, 170 in each of the receiving apertures 140 permits adjustable positioning of attachment means therein, thereby enabling adjustable attachment of the butt hinge 100 to a surface. This makes the process of hanging the door quicker, more straightforward and less susceptible to user error.

9 Claims, 3 Drawing Sheets

BUTT HINGE

RELATED APPLICATIONS

This application claims priority under 35 U.S.C. § 119 to co-pending GB Application 2000966.8, filed Jan. 23, 2020 and incorporated by reference herein in its entirety.

FIELD

The present invention relates generally to a butt hinge and a method of attaching a butt hinge and finds particular, although not exclusive, utility in hanging doors.

BACKGROUND

It is known to provide doors with butt hinges, otherwise known as mortise hinges. A butt hinge is constructed from two corresponding leaves connected with a central pivoting system, usually comprising a pin and barrel. One leaf of the butt hinge is then mortised, or recessed, into the door while the other leaf is mortised into to the door frame. When installed, the two leaves sit flush against one another, allowing the door to sit flush with the door frame.

SUMMARY

Several problems may be encountered when hanging a door with a butt hinge. A high degree of accuracy is required when mortising and drilling holes in the door and the door frame, as small margins of error in the alignment of the butt hinge may lead to the door being incorrectly hung. Consequently, the incorrectly hung door may impinge upon the floor when opened, or may be overly biased to being open or closed due to the erroneous angular offset introduced by the incorrectly attached hinge. Similar problems may be encountered when replacing an existing door. To resolve these problems, new holes must be drilled in the door frame, with the old holes requiring filling. The existing mortising may also require modification to accommodate the newly positioned hinge, which may reduce the structural strength and/or aesthetics of the attachment. These solutions significantly contribute to the time and effort required to hang the door.

In a first aspect, the present invention provides a butt hinge comprising: a first leaf for attachment to a door; a second leaf pivotally attached to the first leaf, the second leaf for attachment to a surface, the second leaf comprising at least three receiving apertures therein; a plurality of first inserts comprising a first outer circumference and a first inner aperture therein, the first inner aperture configured to be concentric with the first outer circumference; and a plurality of second inserts comprising a second outer circumference and a second inner aperture therein, the second inner aperture configured to be eccentric with the second outer circumference; wherein each one of the receiving apertures is configured to selectively receive a first insert or a second insert, and each of the second inserts is configured to be rotatable relative to the second leaf on insertion into a receiving aperture; whereby arrangement of the inserts in each of the receiving apertures permits adjustable positioning of attachment means therein, thereby enabling adjustable attachment of the butt hinge to the surface.

In this way, the second leaf and thus the butt hinge may have a wide range of possible attachment configurations. Consequently, once the first leaf is attached to the door, the angle and position of the second leaf relative to the surface may be adjusted via selection and positioning of the inserts. Any existing screw holes in the surface can be reused, without the requirement to drill new holes or fill in the old ones. Alternatively, new holes can be drilled spaced from the old holes so that, again, the old holes do not require filling. This makes the process of hanging the door quicker, more straightforward and less susceptible to user error.

The butt hinge may comprise a conventional pin and barrel pivot, and/or any other pivotable mechanism for attachment of the first and second leaves.

The butt hinge may be constructed from metal, plastics, and/or any other material able to bear the load of a door the butt hinge is attached to.

The first leaf may be substantially rectangular, square or another polygonal shape. Alternatively, the first leaf may be circular or ovoid.

The first leaf may be for instance between 10 and 50 mm wide, in particular between 20 and 40 mm wide, more particularly between 20 and 25 mm wide. The first leaf may be for instance between 50 and 150 mm long, in particular between 70 and 120 mm long, more particularly between 80 and 100 mm long. The first leaf may be between 1 and 3 mm thick, in particular between 1.5 and 2 mm thick.

The first leaf may comprise apertures therein, for inserting attachment means therethrough.

The first leaf may be attachable to a door with screws, nails, glue, and/or any other attachment means.

The first leaf may comprise a plurality of sub-leaves. Alternatively, the first leaf may be unitary.

The second leaf may be for instance between 10 and 50 mm wide, in particular between 20 and 40 mm wide, more particularly between 20 and 25 mm wide. The second leaf may be for instance between 50 and 100 mm long, in particular between 70 and 90 mm long, more particularly between 80 and 85 mm long. The second leaf may be between 1.5 and 5 mm thick, in particular between 2 and 4.5 mm thick. The thickness of the second leaf may be the same or different to the thickness of the first leaf.

The second leaf may be attachable to the surface with screws, nails, and/or any other attachment means that fit through the insert inner apertures.

The second leaf may comprise a plurality of sub-leaves. Alternatively, the second leaf may be unitary.

Each of the at least three receiving apertures may be circular in shape, in a plane parallel to the planar surface of the second leaf. Alternatively, they may be square, or any other shape. The at least three receiving apertures may be for instance between 10 and 25 mm across, in particular between 15 and 20 mm across, more particularly between 17 and 19 mm across. There may be more than three receiving apertures, for example four or five receiving apertures.

The first inserts and second inserts may be sized to fit snugly within the receiving apertures. Accordingly, the first and second inserts may be for instance between 10 and 25 mm across, in particular between 15 and 20 mm across, more particularly between 17 and 19 mm across.

The first inserts and second inserts may have a shape corresponding to the shape of the receiving apertures, for instance circular, square and/or any other shape.

Insertion of the first inserts and the second inserts into the receiving apertures may mean that at least a portion of the inserts is recessed within the receiving apertures. Alternatively, insertion may mean that the entirety of each insert is recessed within the receiving aperture, such that the top face of each insert is flush with the top face of the second leaf. Additionally, insertion may mean that the top face of each insert is recessed behind the top face of the second leaf.

The first inner aperture being concentric with the first outer circumference of the first insert may mean that the centres of the first inner aperture and the first outer circumference substantially overlap. In this way, the first inner aperture may always be located in the centre of the receiving aperture when the first insert is inserted.

The second inner aperture being eccentric with the second outer circumference may mean that the centres of the second inner aperture and the first outer circumference do not overlap. In this way, when a second insert is received within a receiving aperture, rotation of the second insert varies the position of the second inner aperture relative to the receiving aperture.

Each of the receiving apertures may receive a first insert, alternatively each of the receiving apertures may receive a second insert. In particular, the at least three receiving apertures may receive a selected combination of first inserts and second inserts, thereby permitting many adjustable fixing arrangements of the butt hinge to a surface.

The at least three receiving apertures may have a tapered and/or stepped profile along an axis parallel to the thickness of the second leaf.

The tapered and/or stepped profile may be such that each receiving aperture comprises a large portion at a first face of the second leaf and a small portion at a second face of the second leaf.

In this way, the first and second inserts may be easily inserted into the receiving apertures, without being recessed too far. Accordingly, they may be easier to position and rotate within the receiving apertures, as the face of the insert being manipulated by a user is accessible. This may also make it easier to remove and replace inserts according to a user's requirements.

The large portion of each of the receiving apertures may have a diameter of between 17 and 19 mm. The small portion of each of the receiving apertures may have a diameter of between 15 and 17 mm.

The first inserts and the second inserts may have a tapered and/or stepped cross-sectional profile.

The tapered and/or stepped cross-sectional profile may be such that a small portion of the thickness of each insert recesses into the small portion of each receiving aperture, and a large portion of the thickness of the insert recesses into the large portion of each receiving aperture.

In this way, the inserts may be easily inserted into the receiving apertures and rotated therein. With the thickness profile of the receiving apertures corresponding to the thickness profile of the inserts, the retention of the inserts within the receiving apertures may be improved.

The large portion of each of the inserts may have a diameter of between 17 and 19 mm. The small portion of each of the inserts may have a diameter of between 15 and 17 mm.

The second leaf may be at least 50% thicker than the first leaf.

In this way, the second leaf of the butt hinge may be thicker in profile than the mortise inherited from an old hinge previously attached to the surface. Accordingly, new mortising may be carried out to reseat the butt hinge in the old screw holes, using newly mortised material and removing the need for repair of the surface. This improves the attachment of the second leaf to the old surface, and may also improve the aesthetic appeal of the finished arrangement. The standard thickness of the first leaf means no additional mortising of the door is required.

The first leaf may be between 22 and 24 mm wide, and between 80 and 82 mm long.

The second leaf may be between 22 and 24 mm wide, and between 80 and 82 mm long.

The first inner aperture and the second inner aperture may be countersunk.

In this way, the insertion and recession of screws within the inner apertures is improved.

The first leaf may comprise at least three receiving apertures therein, configured in the same way as the receiving apertures in the second leaf.

In this way, the adjustable attachment process of the second leaf to the surface may also be workable for the first leaf to the door. This allows for a high degree of adjustability of the butt hinge attachment.

In a second aspect, the invention provides a method of attaching a butt hinge to a surface, the method comprising the steps of: providing the butt hinge of the first aspect; aligning the second leaf on a surface; selecting and arranging either one of a first insert and a second insert in each of the receiving apertures; inserting attachment means through the first and/or second inner apertures; and attaching the second leaf to the surface.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTI ON

Figure 1:
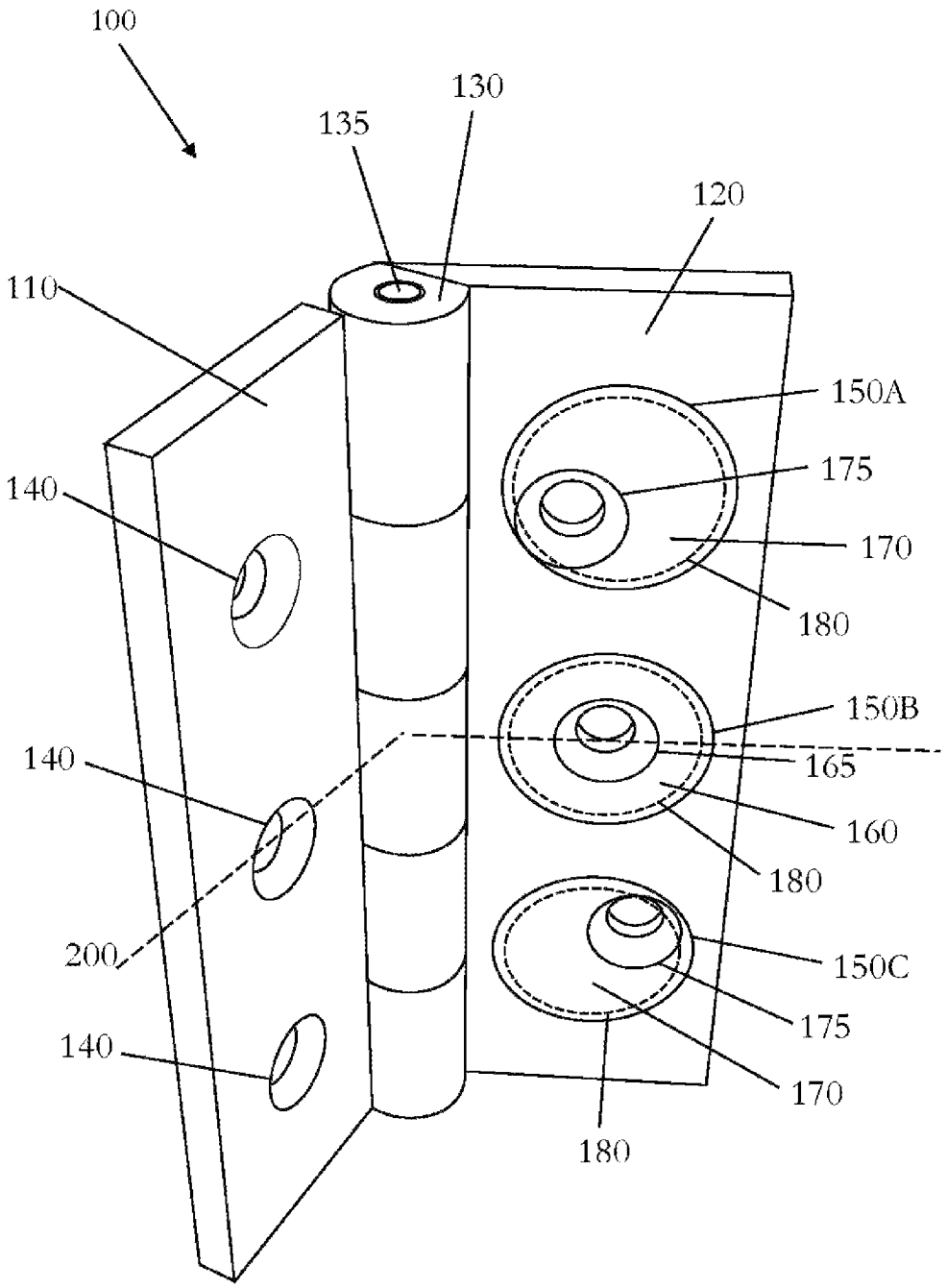
FIG. 1 is a frontal view of a butt hinge with inserts.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein. Likewise, method steps described or claimed in a particular sequence may be understood to operate in a different sequence.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any one embodiment or aspect of the invention may be combined in any suitable manner with any other particular feature, structure or characteristic of another embodiment or aspect of the invention, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The principles of the invention will now be described by a detailed description of at least one drawing relating to exemplary features. It is clear that other arrangements can be configured according to the knowledge of persons skilled in the art without departing from the underlying concept or technical teaching, the invention being limited only by the terms of the appended claims.

FIG. 1 shows a butt hinge 100 with a first leaf 110 and second leaf 120. The first 110 and second 120 leaves are rectangular in shape, and are longer in the vertical axis than they are along the horizontal axis. The first 110 and second 120 leaves are connected together by a pivotal mechanism 130 in between, which runs the entire vertical length of the butt hinge 100 and comprises approximately 15% of its horizontal width. The pivotal mechanism 130 is a conventional pin and barrel pivot, with five interlocking members surrounding the pin 135; however, other numbers of interlocking members, such as three, four, six or seven are also envisaged.

The first leaf 110 comprises three apertures 140, circular in shape and positioned in the horizontal centre of the first leaf 110 and spaced evenly along the vertical length of the first leaf 110. Each of the apertures 140 is countersunk to facilitate the arrangement of screws therein. The second leaf 120 comprises three receiving apertures 150A, 150B, 150C, positioned in the horizontal centre of the second leaf 120 and spaced evenly along the vertical length of the first leaf 110. The middle receiving aperture 150B is shown with an inserted first insert 160, which comprises a concentric countersunk inner aperture 165. The top 150A and bottom 150C receiving apertures are shown with inserted second inserts 170, which each comprise an eccentric countersunk inner aperture 175.

Each of the receiving apertures 150A, 150B, 150C and each of the inserts 160, 170 has a stepped thickness profile interjected by a shoulder 180. The shoulder 180 is shown in broken lines to indicate it being out of view, being obscured by the top surface of the inserts 160, 170. The stepped profile facilitates easy insertion of the inserts 160, 170 into the receiving apertures 150A, 150B, 150C. A large portion of the thickness of the inserts 160, 170 is coincident with the diameter of the receiving apertures 150A, 150B, 150C. A small portion of the thickness of the inserts 160, 170 is recessed into the corresponding smaller diameter of the receiving apertures 150A, 150B, 150C.

Figure 2:
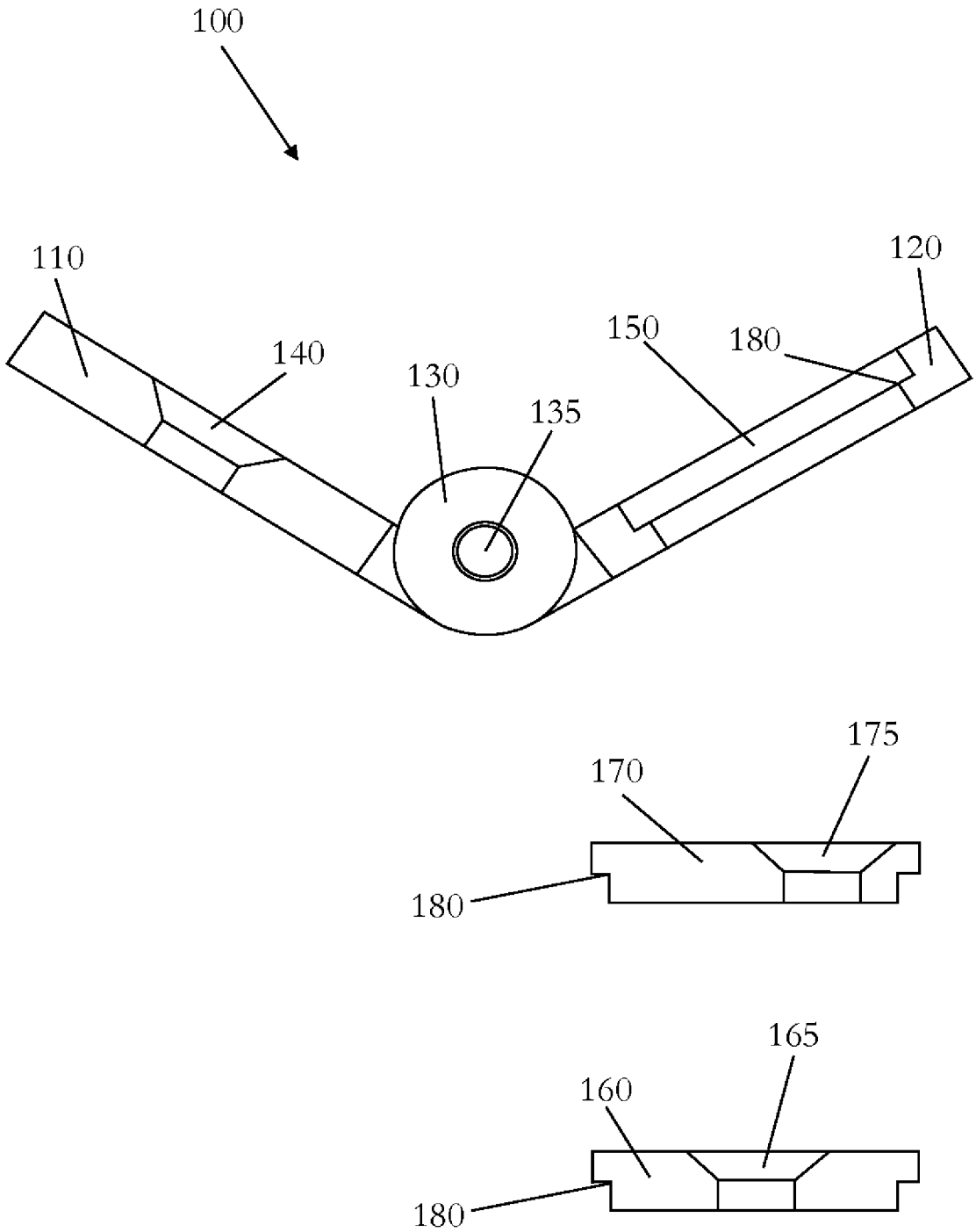
FIG. 2 is a cross-sectional view of the butt hinge and inserts of FIG. 1, shown with the inserts out of the receiving apertures.

FIG. 2 shows a cross sectional view taken through the centre of the butt hinge 100 in FIG. 1, along the central plane 200, without any inserts in the second leaf 120. The countersunk aperture 140 is positioned in the horizontal middle of the first leaf 110. The second leaf 120 is twice the thickness of the first leaf 110. The pivotal mechanism 130 has a circular profile, which protrudes above the flat surfaces of the first 110 and second 120 leaves. The pin 135 is a circular member in the centre of the mechanism 130.

The central receiving aperture 150B is positioned in the centre of the second leaf 120, and is shown without an insert. The receiving aperture 150B has a stepped profile interjected by a shoulder 180 approximately halfway along its thickness. Accordingly, the lateral size of the receiving aperture 150B at the top surface of the second leaf 120 is larger than the lateral size of the receiving aperture 150B at the bottom surface of the second leaf 120.

The first insert 160 and second insert 170 are shown separate from the second leaf 120, each in cross-section. The first 160 and second 170 insert have a stepped profile interjected by a shoulder 180 that corresponds to the receiving aperture 150B, allowing them to fit snugly within the receiving aperture 150B when inserted. Both the first insert 160 and the second insert 170 have a countersunk inner aperture therein. The inner aperture 165 in the first insert 160 is concentric, and accordingly is shown left of centre of the first insert 160. The inner aperture 175 in the second insert 170 is eccentric, and accordingly is shown in the centre of the second insert 170.

Figure 3:
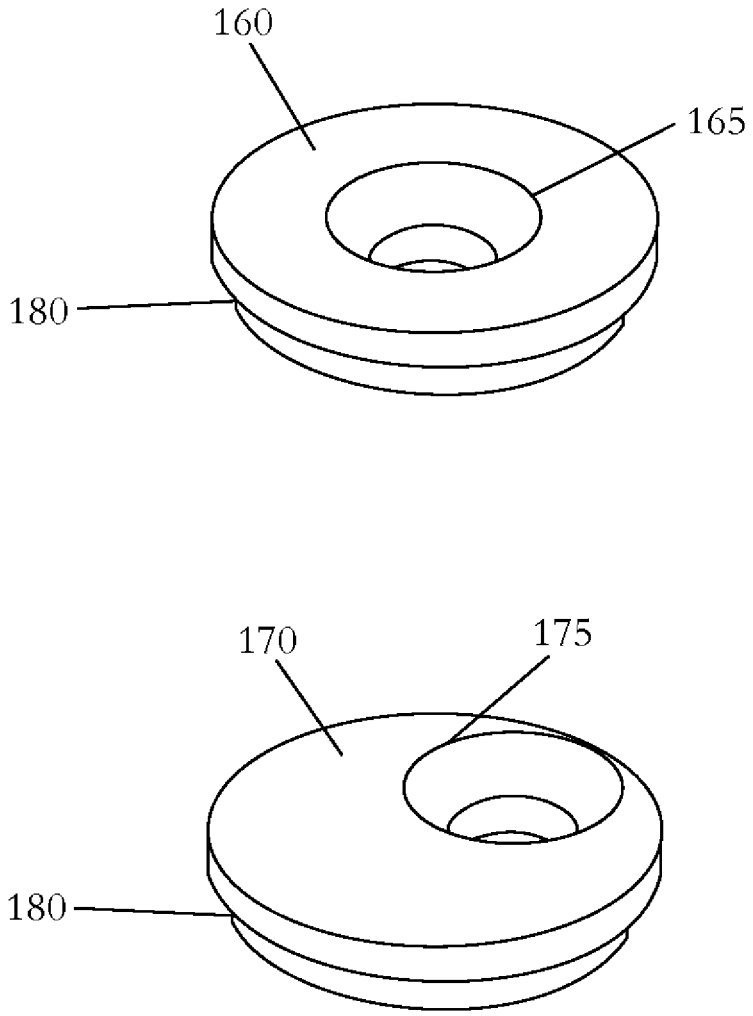
FIG. 3 is a perspective view of a first insert and a second insert.

FIG. 3 is a perspective view of the first insert 160 and the second insert 170. The concentric inner aperture 165 is in the centre of the first insert 160. The eccentric inner aperture 175 in the second insert 170 is on the right-hand side of the second insert 170. Both inner apertures 165, 175 are countersunk. The stepped profile interjected by a shoulder 180 in both of the inserts 160, 170 is shown by the smaller portion of the insert thickness protruding from the bottom of each insert, smaller in lateral extent than the larger portion of the top of the insert above it.

The invention claimed is:

1. A butt hinge comprising:

a first leaf for attachment to a door;

a second leaf pivotally attached to the first leaf, the second leaf for attachment to a surface, the second leaf comprising at least three receiving apertures therein;

a plurality of first inserts comprising a first outer circumference and a first inner aperture therein, the first inner aperture configured to be concentric with the first outer circumference; and a plurality of second inserts comprising a second outer circumference and a second inner aperture therein, the second inner aperture configured to be eccentric with the second outer circumference;

wherein each one of the receiving apertures is configured to selectively receive a first insert or a second insert, and each of the second inserts is configured to be rotatable relative to the second leaf;

whereby arrangement of the respective insert in each of the receiving apertures permits adjustable positioning of attachment means therein, thereby enabling adjustable attachment of the butt hinge to the surface.

2. The butt hinge of claim 1, wherein each of the at least three receiving apertures has a tapered and/or stepped profile along an axis parallel to the thickness of the second leaf.

3. The butt hinge of claim 1, wherein the first inserts and the second inserts have a tapered and/or stepped cross-sectional profile.

4. The butt hinge of claim 1, wherein the second leaf is at least 50% thicker than the first leaf.

5. The butt hinge of claim 1, wherein the first leaf is between 22 and 24 mm wide, and between 80 and 82 mm long.

6. The butt hinge of claim 1, wherein the second leaf is between 22 and 24 mm wide, and between 80 and 82 mm long.

7. The butt hinge of claim 1, wherein the first inner aperture and the second aperture are countersunk.

8. The butt hinge of claim 1, wherein the first leaf comprises at least three receiving apertures therein, configured in the same way as the receiving apertures in the second leaf.

9. A method of attaching a butt hinge to a surface, the method comprising the steps of:

providing the butt hinge of claim 1;

aligning the second leaf on a surface;

selecting and arranging either one of the plurality of first inserts or one of the plurality of second inserts in each of the receiving apertures;

inserting attachment means through the first and/or second inner apertures; and attaching the second leaf to the surface.

* * * * *